US008939557B2

(12) United States Patent
Netsu

(10) Patent No.: US 8,939,557 B2
(45) Date of Patent: Jan. 27, 2015

(54) LIQUID DISCHARGE HEAD

(71) Applicant: Canon Kabushiki Kaisha, Tokyo (JP)

(72) Inventor: Hiroshi Netsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/911,425

(22) Filed: Jun. 6, 2013

(65) Prior Publication Data

US 2013/0342611 A1 Dec. 26, 2013

(30) Foreign Application Priority Data

Jun. 22, 2012 (JP) ..... 2012-140842

(51) Int. Cl.
*B41J 2/045* (2006.01)
*B41J 2/14* (2006.01)
*B41J 2/16* (2006.01)

(52) U.S. Cl.
CPC ..... *B41J 2/14233* (2013.01); *B41J 2/14209* (2013.01); *B41J 2/1609* (2013.01); *B41J 2/1631* (2013.01); *B41J 2/1634* (2013.01); *B41J 2/1642* (2013.01); *B41J 2/1645* (2013.01); *B41J 2202/11* (2013.01)
USPC ..... 347/71; 347/68

(58) Field of Classification Search
None
See application file for complete search history.

(56) References Cited

U.S. PATENT DOCUMENTS

| | | | | |
|---|---|---|---|---|
| 5,432,540 | A * | 7/1995 | Hiraishi | 347/69 |
| 8,517,491 | B2 | 8/2013 | Netsu | |
| 2007/0070125 | A1 * | 3/2007 | Watanabe | 347/58 |
| 2013/0093819 | A1 | 4/2013 | Nakakubo et al. | |

FOREIGN PATENT DOCUMENTS

JP 2007-168319 A 7/2007

* cited by examiner

*Primary Examiner* — Geoffrey Mruk
(74) *Attorney, Agent, or Firm* — Fitzpatrick, Cella, Harper & Scinto

(57) ABSTRACT

In a liquid discharge head including a surface plate having a plurality of discharge ports and a liquid discharge body having a discharge portion, the discharge portion and an opening are alternately arranged on the liquid discharge body and the liquid discharge body includes a bonding unit formed by combining two piezoelectric material plates. Each piezoelectric material plate is provided with a plurality of grooves on a first surface and has a first electrode on one side wall surface and the bottom of the groove of the piezoelectric material plate, a second electrode on the other side wall surface, and a third electrode on a second surface. Each piezoelectric material plate is polarized in a direction connecting the first electrode and the second electrode, and also in a direction connecting the first electrode and the third electrode, and the two piezoelectric material plates are bonded so that the first surfaces face each other to form the bonding unit.

9 Claims, 11 Drawing Sheets

LIQUID DISCHARGE HEAD

BACKGROUND OF THE INVENTION

1. Field of the Invention

The present invention relates to a liquid discharge head which is provided in an ink-jet recording apparatus which performs a recording operation by discharging ink or other liquids.

2. Description of the Related Art

An inkjet recording apparatus which records characters and images into a recording medium by discharging ink has a liquid discharge head (inkjet recording head) which discharges ink. The configuration and manufacturing method of a liquid discharge head which is composed of cylindrical ink discharge portions (piezoelectric elements) made of piezoelectric material and has a pressure chamber whose volume is able to be reduced by a deformation of the ink discharge portion due to voltage application are disclosed in Japanese Patent Application Laid-Open No. 2007-168319.

The liquid discharge head includes a unit stack (piezoelectric element substrate) and has a plurality of ink discharge portions each of which is formed in a square cylinder shape and has a passing hollow formed inside. More specifically, the ink discharge portion is composed of four wall portions constituting a pressure chamber which is formed by the aforementioned hollow and discharges ink. Upon supply of an electrical signal to the ink discharge portion, the four wall portions constituting the pressure chamber inflate into a barrel shape, thereby reducing the volume of the pressure chamber to discharge ink accumulated in the pressure chamber.

The pressure chambers are formed by the same number of grooves by stacking a plurality of piezoelectric material plates (piezoelectric plates), in which a plurality of grooves extending in the same direction is formed, with the grooves aligned in direction. Thereafter, the stacked piezoelectric material plates are cut in a direction orthogonal to the groove direction, by which a plate-like unit stack in which the pressure chambers are arranged in a matrix is obtained. Ink discharge portion separation grooves are formed so as to surround each of the pressure chambers arranged in a matrix of the unit stack, by which two or more cylindrical ink discharge portions separate from each other are formed. Thus, the unit stack has a matrix of high-density pressure chambers defined by the groove pitch of the piezoelectric material plate and the thickness of the piezoelectric material plate.

The unit stack having the ink discharge portions is assembled with an orifice plate (nozzle plate), a printed-wiring board, a rear throttle plate (supply passage plate), and a common liquid chamber (ink pool plate), by which a liquid discharge head is completed.

In the invention disclosed in Japanese Patent Application Laid-Open No. 2007-168319, each ink discharge portion is formed in a substantially independent square cylinder shape. Therefore, the wall portion is thin in thickness in the range of the outer peripheral surface of the ink discharge portion to the inner peripheral surface (the inner surface of the pressure chamber), which leads to low durability of the ink discharge portion. In the case of discharging high-viscosity ink for high-quality picture recording, it is necessary to increase the ink discharge force of the pressure chamber, which requires a longer pressure chamber. To make the pressure chamber longer, however, the ink discharge portion needs to be elongated, and the elongation of the thin wall portion of the square-cylinder-shaped ink discharge portion having the hollow further reduces the durability of the ink discharge portion. This might disable ink discharge due to breakage of the wall portion of the ink discharge portion which is caused by vibration generated when characters or images are recorded into a recording medium or the deflation of the ink discharge portion repeated to discharge the high-viscosity ink. Therefore, it is required to provide a durable ink discharge portion capable of discharging high-viscosity ink.

Meanwhile, in order to form the ink discharge portion into a square cylinder shape, it is necessary to form an ink discharge portion separation groove which forms a square cylinder shape around each of the pressure chambers arranged in a matrix in the unit stack. For high-resolution recording, it is desired to arrange the ink discharge portions which discharge ink densely as much as possible. In the invention disclosed in Japanese Patent Application Laid-Open No. 2007-168319, however, an ink discharge portion separation groove exists between ink discharge portions adjacent to each other and therefore the width of each ink discharge portion separation groove needs to be reduced to increase the density. The ink discharge portion separation groove is formed by a cutting process such as sandblasting or the like and therefore there is a limit on the reduction in the width of the ink discharge portion separation groove. This results in a large arrangement pitch of the cylindrical ink discharge portion, by which it is impossible to arrange the ink discharge portions densely in the unit stack.

Further, in the invention disclosed in Japanese Patent Application Laid-Open No. 2007-168319, common electrodes having the ground potential and individual electrodes independent of each other are wired on the same printed-circuit board. Therefore, it is required to wire the respective individual electrodes away from the respective common electrodes so as not to electrically come in contact with the common electrodes, which requires the common electrodes to be collectively arranged in one part. Accordingly, there is provided a common electrode post (a piezoelectric body for connecting the common electrodes) for electrically collecting the common electrodes together. The common electrode post is disposed by using a space of one line of the ink discharge portion on the unit stack. As a result, one line of the ink discharge portion needs to be eliminated in the arrangement, by which the ink discharge portions are not densely arranged on the unit stack. Therefore, it is required to provide a unit stack having ink discharge portions more densely arranged so as to achieve recording at higher resolution.

SUMMARY OF THE INVENTION

Therefore, the object of the present invention is to provide a liquid discharge head which solves the above problem and which has a unit stack provided with densely-arranged ink discharge portions having durability enabling high-viscosity ink to be repetitively discharged independently of the length of the unit stack.

In order to achieve the above object, the present invention provides a liquid discharge head including: a surface plate having a plurality of discharge ports for discharging liquid; and a liquid discharge body having a discharge portion for supplying the liquid to the discharge ports, wherein: the discharge portion and an opening are alternately arranged on the liquid discharge body and the liquid discharge body includes a bonding unit formed by combining two piezoelectric material plates; and the piezoelectric material plate is provided with a plurality of grooves on a first surface and has a first electrode on one side wall surface and the bottom of the groove of the piezoelectric material plate, a second electrode on the other side wall surface of the groove of the piezoelectric material plate, and a third electrode on a second surface which is a rear surface opposite to the first surface of the piezoelectric material plate, the piezoelectric material plate is polarized in a direction connecting the first electrode, the second electrode, and the third electrode, and the two piezoelectric material plates are bonded so that the first surfaces face each other to form the bonding unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

An ink-jet recording apparatus which records characters and images by discharging ink, which is liquid, to a recording medium includes an ink tank in which ink is stored, a liquid discharge head provided with nozzles for discharging ink, and a carriage which holds the liquid discharge head. When the ink-jet recording apparatus records the characters and images to the recording medium, the carriage reciprocates on the recording medium while the liquid discharge head discharges inks of various colors by appropriate amounts in appropriate positions of the recording medium. The recording medium is sequentially fed at a predetermined pitch in time with the reciprocation of the carriage, by which the discharge positions of the inks shift on the recording medium. The carriage and the recording medium move in this manner, by which image data is recorded on the recording medium.

The configuration of the liquid discharge head which discharges ink is described below.

Figure 1A:
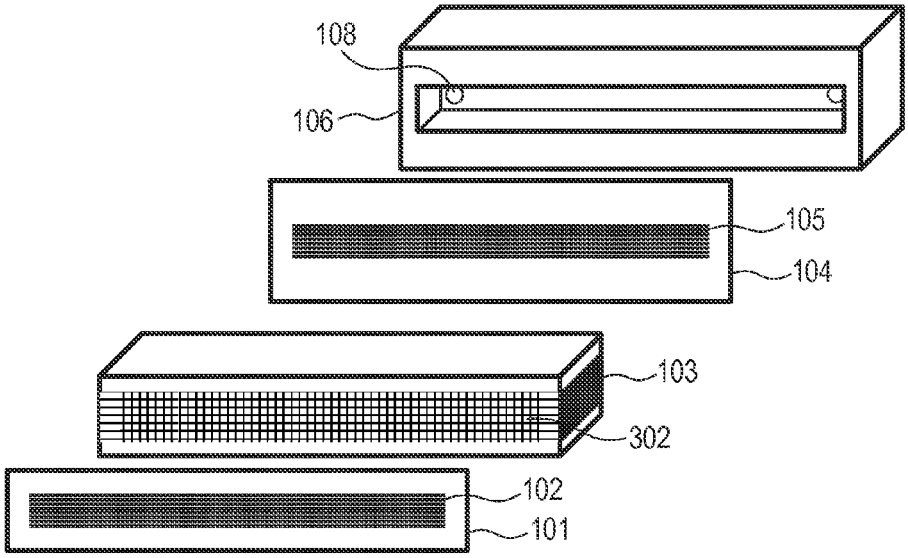
FIG. 1A is an exploded perspective view illustrating the exploded state of a liquid discharge head according to an embodiment of the present invention.
Figure 1B:
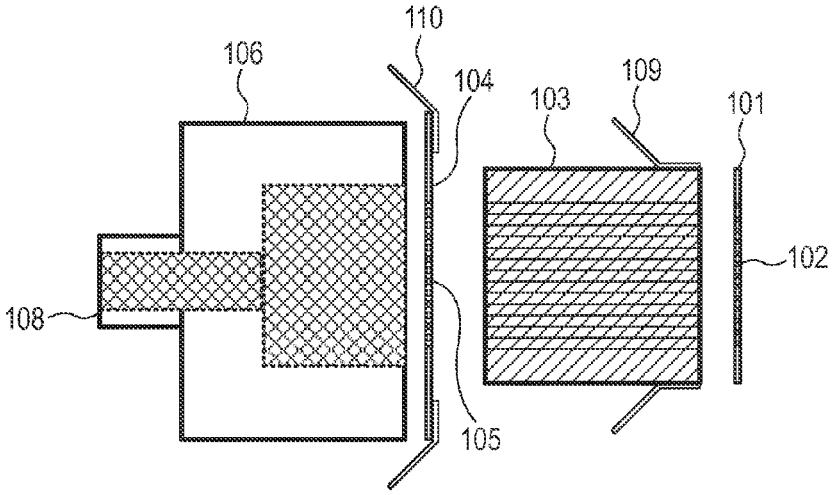
FIG. 1B is an exploded cross-sectional view of FIG. 1A.

As illustrated in FIGS. 1A and 1B, the liquid discharge head of this embodiment includes an orifice plate (surface plate) 101, a unit stack (liquid discharge body) 103, a rear throttle plate 104, and a common liquid chamber 106. The orifice plate 101 is provided with a plurality of nozzle holes (discharge ports) 102 from which ink is discharged to the recording medium and is formed of silicon, Ni, or the like. The nozzle holes 102 are arranged so as to communicate with a plurality of pressure chambers 302 (discharge portions) of the unit stack 103 and pass through the orifice plate 101. The nozzle hole 102 is a circular hole having a diameter ($\phi$) of 10 μm and the orifice plate 101 has a thickness of 20 μm.

Figure 2A:
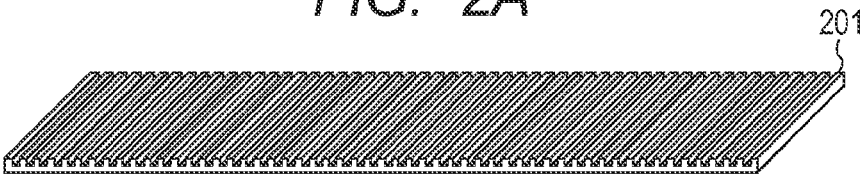
FIG. 2A is a perspective view of a piezoelectric material plate having grooves of a first embodiment.
Figure 3A:
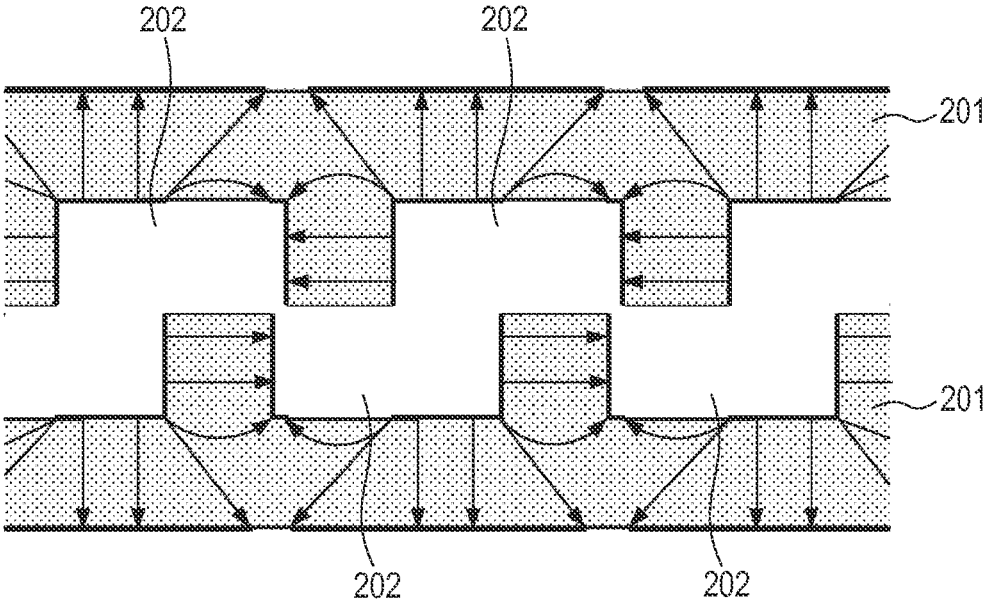
FIG. 3A is a front view illustrating a state before combining the piezoelectric material plates illustrated in FIG. 2A.
Figure 3B:
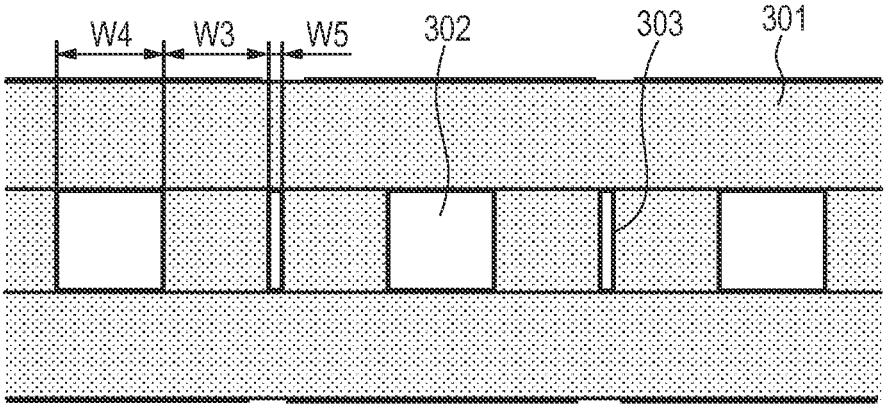
FIG. 3B is a front view illustrating a bonding unit in which the piezoelectric material plates are combined.
Figure 3C:
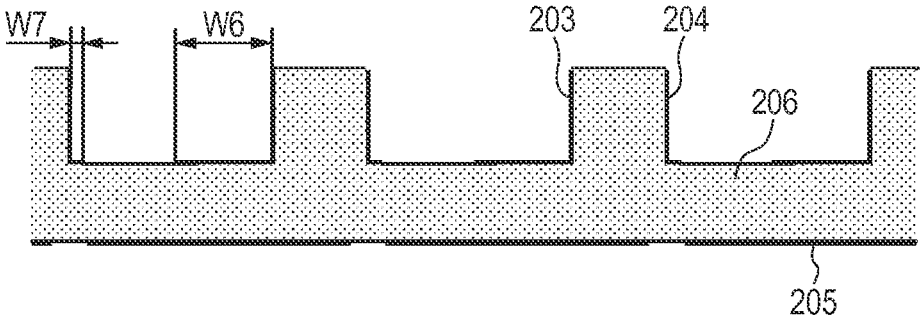
FIG. 3C is a diagram illustrating the dimensional relation of the electrodes of the piezoelectric material plate.
Figure 4:
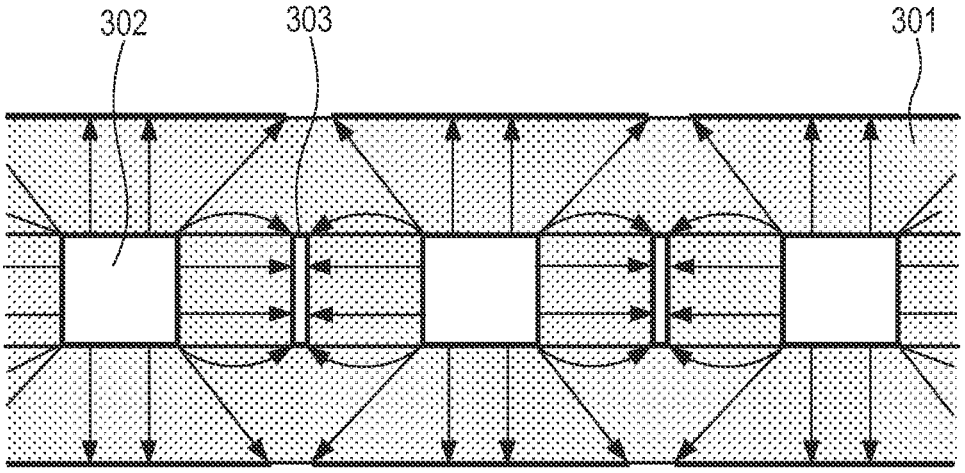
FIG. 4 is a diagram illustrating an electric field distribution in a state where a drive voltage is applied to the electrodes illustrated in FIG. 3C.

A bonding unit 301 is formed by combining two piezoelectric material plates 201 as illustrated in FIG. 3B, where the piezoelectric material plate 201 is grooved as illustrated in FIG. 2A and made of PZT (lead zirconium titanate). There are provided a pressure chamber 302, which discharges ink, and a first opening (opening) 303 alternately in the horizontal direction (a direction parallel to the main surface of the piezoelectric material plate 201). On an inner peripheral surface of the pressure chamber 302, there is provided an individual electrode 203, which is an electrically-independent first electrode and receives an electrical signal individually, in order to move each pressure chamber 302 independently. On an inner peripheral surface of the first opening 303, there is provided a common electrode 204 which is a second electrode. Moreover, there are provided common electrodes 205 which are third electrodes on the upper and lower surfaces of the bonding unit 301. The common electrodes 204 and 205 are electrically connected to each other and are ground electrodes. As illustrated in FIG. 4, the bonding unit 301 is polarized in a direction from the individual electrode 203 toward the common electrodes 204 and 205.

Figure 5:
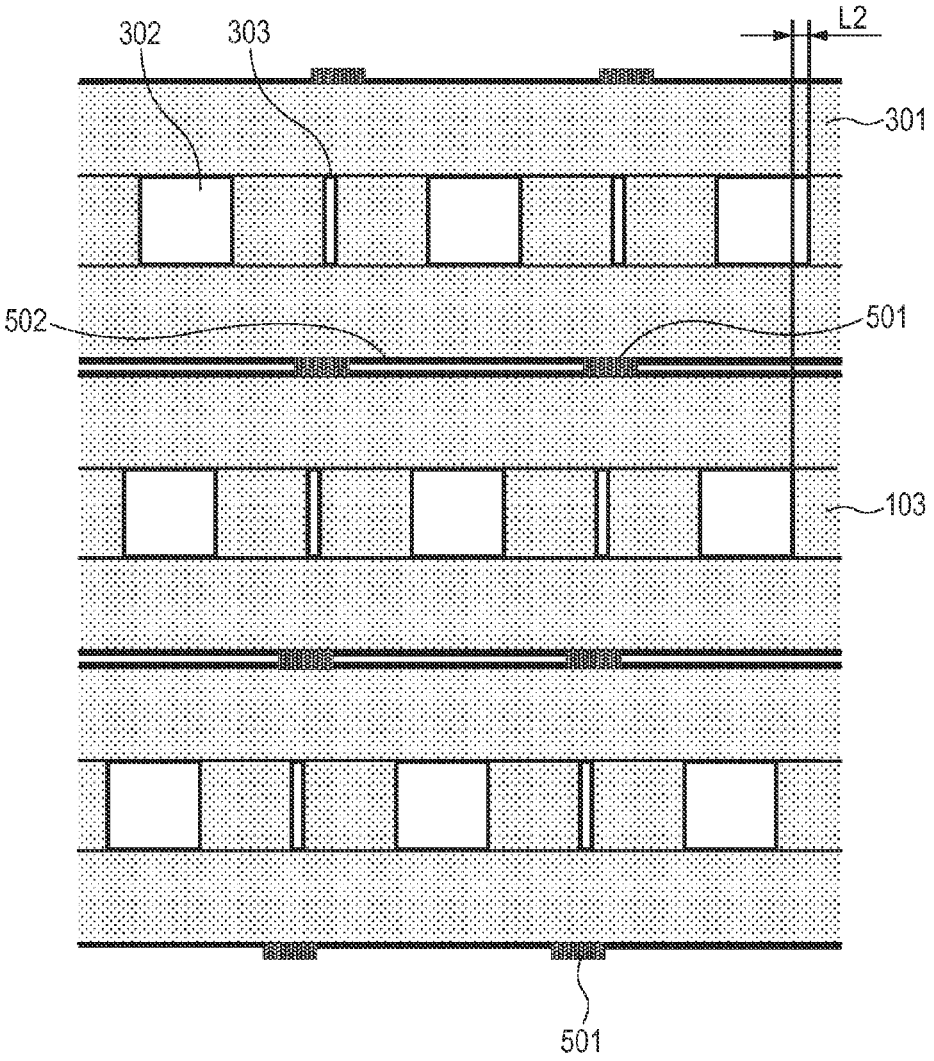
FIG. 5 is a front view illustrating a unit stack in which the bonding units one of which is illustrated in FIG. 3B are stacked.

As illustrated in FIG. 5, two or more bonding units 301 are stacked via spacers 501, by which the unit stack 103 is formed. A part enclosed by the bonding units 301 and the spacers 501 is a second opening (another opening) 502 having the common electrodes 205 on the inner peripheral surface. The second opening 502 and the pressure chamber 302 are located alternately in the vertical direction (in the through-thickness direction of the piezoelectric material plate 201). The first opening 303 and the second opening 502 are under-cuts which allow a deformation which occurs when the surrounding area of the pressure chamber 302 is inflated by the piezoelectric effect. The unit stack 103 is connected to a common electrode distribution cable 109, which includes flexible printed circuits (FPC) or the like for electrically drawing out the common electrodes 204 and 205, illustrated in FIG. 1B.

Figure 6A:
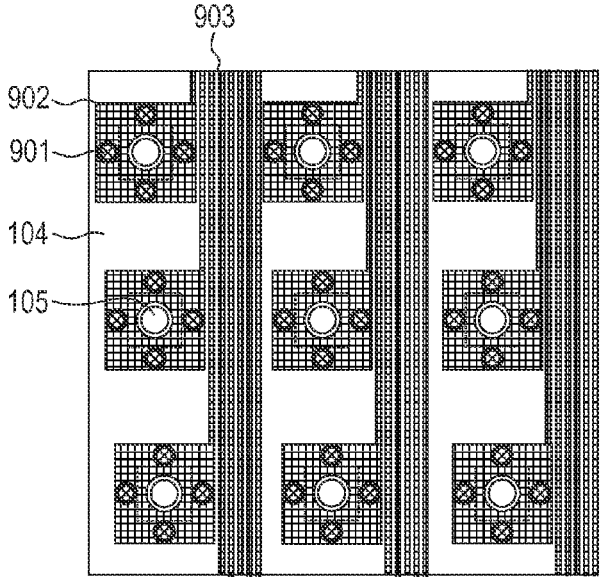
FIG. 6A is a top view of a rear throttle plate.
Figure 7A:
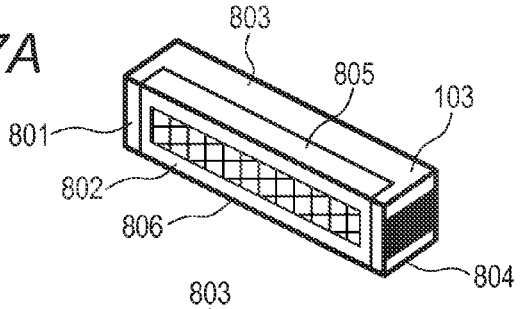
FIG. 7A is a perspective view illustrating a state where a front-end electrode is formed in the unit stack which has been cut.
Figure 7B:
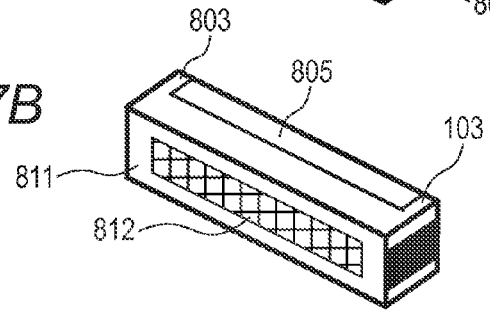
FIG. 7B is a perspective view illustrating a state where a rear-end electrode is formed in the unit stack which has been cut in FIG. 7A.

As illustrated in FIG. 6A, the rear throttle plate 104 has a throttle hole 105 and a bump 901 which is electrically connected to a rear-end electrode 812, illustrated in FIG. 7B, connecting to the individual electrode 203 of the unit stack 103. Moreover, the rear throttle plate 104 has an electrode 902 electrically connected to the bump 901 and is formed of a silicon substrate or the like.

The throttle hole 105 enables ink to flow into the nozzle hole 102 without a backflow of the ink to the common liquid chamber 106 by the drive of the pressure chamber 302. The throttle holes 105 are arranged so as to communicate with a plurality of pressure chambers 302 of the unit stack 103 and pass through the rear throttle plate 104. The diameter of the throttle hole 105 is smaller than the diameter of the opening of the pressure chamber 302. If the opening of the pressure chamber 302 has a square shape of 120 μm×120 μm, the throttle hole 105 has a diameter of about 60 μm and a thickness of 200 μm. In order to transmit the drive voltage from the electrode 902 to the individual electrode 203, lead wires 903 are separately formed at the upper end and the lower end of the rear throttle plate 104 and are connected to an individual electrode distribution cable 110 at the upper end and the lower end. Furthermore, it is preferable to form an insulating film in areas other than the portions connected to the bump 901 and to the individual electrode distribution cable 110 in order to prevent a short circuit with the electrode provided on a rear end surface 811 of the unit stack 103 or a corrosion caused by a contact with discharged ink.

The common liquid chamber 106 has a liquid in-out port 108 which allows ink supplied from an ink tank, which is not illustrated, to flow in and out.

The configuration of the unit stack 103 will be further described with reference to FIGS. 2A to 3C. The liquid discharge head is adapted to achieve an image resolution of 1200 dpi, namely a dot size of 21.2 μm.

The unit stack 103 is formed by stacking the bonding units 301 each of which is composed of two piezoelectric material plates 201, illustrated in FIG. 2A, bonded facing each other. The piezoelectric material plate 201 has grooves 202 each of which forms a pressure chamber 302 on a first surface and a first opening 303 on the first surface. The individual electrode (first electrode) 203 is formed on one side wall surface of the groove 202 and on a part of the bottom continued therefrom. Moreover, the common electrode (second electrode) 204 is formed on the other side wall surface of the groove 202 and on a part of the bottom continued therefrom. The individual electrode 203 and the common electrode 204 are separated from each other by an electrode separation region 206 in the bottom of the groove 202. In addition, on a second surface which is a rear surface opposite to the first surface of the piezoelectric material plate 201, the common electrode (third electrode) 205 is formed in the opposing portion of the part where the individual electrode 203 is disposed.

In the case where the bonding units 301 are stacked and an image is formed by driving all nozzle holes 102 at the same timing while moving the relative positions to the recording medium in the stacking direction, preferably the nozzle pitch in the stacking direction is set to an integral multiple of a grid interval.

In this embodiment, the thickness W0 of the piezoelectric material plate 201 is assumed to be 237 μm. As illustrated in FIG. 2C, the groove 202 has a pitch W1 of 360.4 μm, which is 17 times that of the dot size, a depth L1 of 118 μm, a width W2 of 242.4 μm, and a wall thickness W3 of 118 μm.

In this embodiment, the bonding unit 301 is formed by bonding the piezoelectric material plates 201 having the same shape to each other with the first surfaces facing each other. In this state, the side wall surfaces of the two piezoelectric material plates 201 are not in close contact with each other and interspaces are generated, by which the pressure chamber 302 and the first opening 303 are formed and alternately arranged. As illustrated in FIG. 3B, the pressure chamber 302 having the individual electrode 203 on the inner peripheral surface has a width W4 of 118 μm, and the first opening 303 having the common electrode 204 on the inner peripheral surface has a width W5 of 6.4 μm. Note that, however, the individual electrodes 203 of the two piezoelectric material plates 201 are not brought into conduction at the time of bonding the piezoelectric material plates 201, but a wiring part at the end of the unit stack 103 is brought into conduction. Therefore, the width W6 of the individual electrode 203 disposed at the bottom of the groove 202 of the piezoelectric material plate 201 illustrated in FIG. 3C does not need to be the same as the width W4 of the pressure chamber 302. Considering a position displacement or the like at bonding the piezoelectric material plates 201, however, preferably the width W6 of the individual electrode 203 is wider than the width W4 of the pressure chamber 302. Similarly, the common electrodes 204 of the two piezoelectric material plates 201 are not brought into conduction at the time of bonding the piezoelectric material plates 201, but a wiring part at the end of the unit stack 103 is brought into conduction. Therefore, the width W7 of the common electrode 204 disposed at the bottom of the groove 202 of the piezoelectric material plate 201 illustrated in FIG. 3C does not need to be the same as the width W5 of the first opening 303. The width W7 of the common electrode 204 disposed at the bottom of the groove 202 has merely an insignificant effect on a displacement of the pressure chamber 302. Therefore, the width W7 may be either narrower or wider than the width W5 of the first opening 303.

In this embodiment, as illustrated in FIG. 5, the unit stack 103 is formed by stacking the plurality of bonding units 301. The bonding units 301 are stacked with the spacers 501 placed therebetween and with a shift of a pitch L2 (=21.2 μm) of the pressure chamber 302. In addition, stacking of the bonding units 301 with the spacers 501 therebetween forms the second openings 502 between the bonding units 301 and the spacers 501. On the inner peripheral surfaces of the second opening 502, there are provided the common electrodes 205 arranged on the rear surfaces of the piezoelectric material plates 201.

Figure 7C:
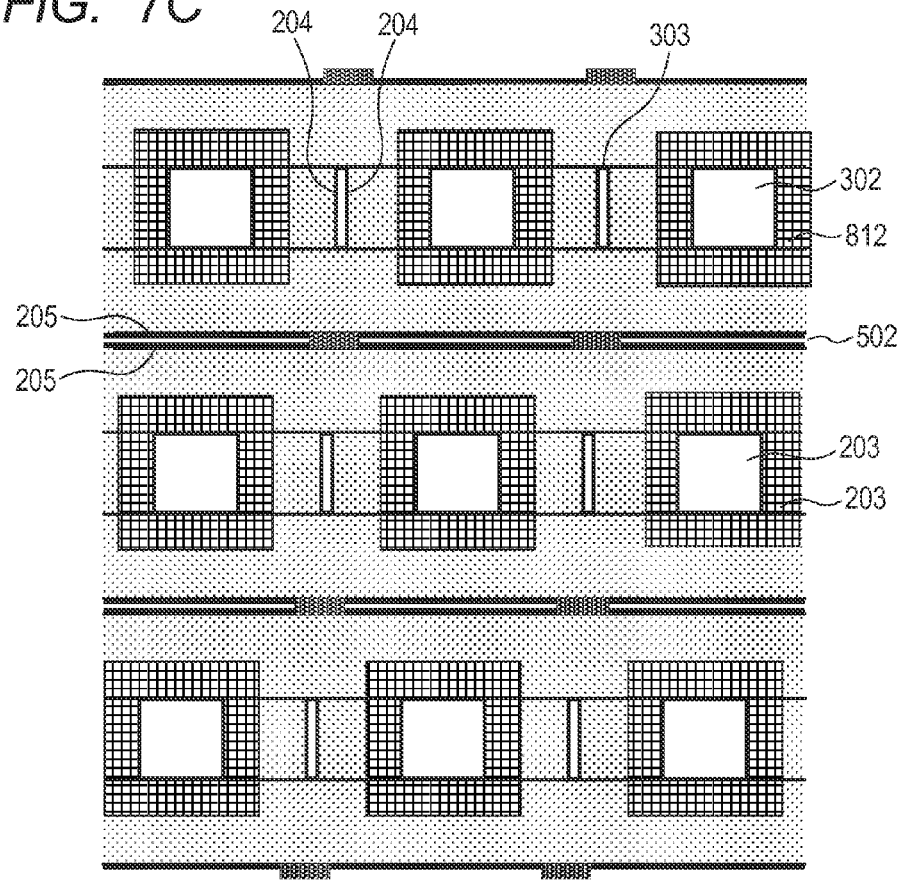
FIG. 7C is a front view of the unit stack in FIG. 7B.

The unit stack 103 illustrated in FIG. 7C has a front-end electrode 802 which is provided on a front end surface 801 and electrically connected to the common electrodes 204 provided on the inner peripheral surfaces of the first openings 303 and the common electrodes 205 provided on the inner peripheral surfaces of the second openings 502. The individual electrodes 203 provided on the inner peripheral surfaces of the pressure chambers 302 are not electrically connected to the front-end electrode 802. As illustrated in FIG. 7A, the front-end electrode 802 is extended from the front end surface 801 of the unit stack 103 to an upper end surface 803 and to a lower end surface 804 and then connected to the common electrode distribution cable 109 in common electrode connection portions 805 and 806. Furthermore, as illustrated in FIG. 7B, the unit stack 103 has a rear-end electrode 812 which is provided on the rear end surface 811 of the unit stack 103 and electrically connected to the individual electrode 203 provided on the inner peripheral surface of the pressure chamber 302. The common electrode 204 provided on the inner peripheral surface of the first opening 303 and the common electrode 205 provided on the inner peripheral surface of the second opening 502 are not electrically connected to the rear-end electrode 812. In this manner, the individual electrodes 203 provided on the inner peripheral surfaces of the pressure chambers 302 are electrically connected to each other at the rear-end electrode 812. Furthermore, the individual electrode 203 is electrically bonded to the electrode 902 which is formed on the rear throttle plate 104 and is adapted to enable each pressure chamber 302 to be driven independently by receiving an external drive signal.

In this embodiment, the small first openings 303 and second openings 502 are discontinuously arranged around each pressure chamber 302 without forming continuous separation grooves and thus the walls constituting the pressure chambers 302 adjacent to each other are connected in a grid pattern. This enables an improvement of the stiffness of the walls constituting the pressure chambers 302. Therefore, durability is improved against vibration generated by the reciprocation of the carriage or a fatigue failure caused by the repetition of ink discharge. Moreover, the width of the first opening 303 and the width of the second opening 502 are extremely smaller than the groove width disclosed in Japanese Patent Application Laid-Open No. 2007-168319, thereby enabling the interval between the pressure chambers 302 adjacent to each other to be reduced. This enables the pressure chambers 302 from which ink is discharged to be densely arranged, thereby enabling recording of high resolution.

The common electrodes 204 and 205 are provided on the inner peripheral surfaces of the first opening 303 and the second opening 502, and the lead wires of the common electrodes 204 and 205 are arranged on the opposite surface of the lead wire of the individual electrode 203 and the unit stack 103, by which the common electrodes 204 and 205 are not electrically connected to the individual electrode 203. Accordingly, there is no need for providing a common electrode post for electrically collecting the common electrodes 204 and 205 together as in Japanese Patent Application Laid-Open No. 2007-168319, thereby enabling the pressure chamber 302 to be formed in the space and consequently enabling the unit stack 103 to have densely-arranged pressure chambers 302.

Therefore, the liquid discharge head of this embodiment has the unit stack 103 provided with densely-arranged pressure chambers 302 having durability enabling high-viscosity ink to be repetitively discharged independently of the length of the unit stack 103.

The following describes the operation of the ink discharge performed by the liquid discharge head for discharging ink having the configuration described above.

In order to discharge ink to a recording medium, ink is supplied to the common liquid chamber 106 from an ink tank not illustrated through the liquid in-out port 108. The ink supplied to the common liquid chamber 106 passes through the throttle hole 105 of the rear throttle plate 104, flows into the pressure chamber 302 of the unit stack 103, and flows up to the nozzle hole 102, by which the ink filling is completed. In this state, the liquid discharge head receives an electrical signal in order to discharge the ink to the recording medium in accordance with received recorded data. Immediately after the liquid discharge head receives the electrical signal, a positive drive voltage is applied to the individual electrode 203 with the common electrodes 204 and 205 as the ground potential, and an electric field as illustrated in FIG. 4 is applied between the individual electrode 203 and the common electrodes 204 and 205. When the electric field energizes the piezoelectric material forming the piezoelectric material plates 201 around the pressure chamber 302, the piezoelectric material is inflated by the piezoelectric effect and consequently the pressure chamber 302 is deflated. Since the pressure chamber 302 is filled with ink in the inside, the deflation of the pressure chamber 302 causes the reduced volume of ink to be discharged from the nozzle hole 102.

In the conventional technique, one or two wall surfaces of the inner peripheral surface of a pressure chamber are formed of piezoelectric material and there has been used the shear mode type where a pressure chamber is deflated by shear deformation, instead of deformation by inflation or deflation of the piezoelectric material. In recent years, however, the demand for high-quality picture recording of characters and images is increasing and therefore high-viscosity ink is often used, and therefore there has been required an ink discharge method superior in a force of discharging ink to the shear mode type.

Accordingly, a "Gould type" is proposed where a pressure chamber itself is formed of piezoelectric material and the pressure chamber is deflated by deformation of the piezoelectric material caused by the piezoelectric effect, as employed in this embodiment. The liquid discharge head of the Gould type of this embodiment is polarized from the individual electrode 203 toward the common electrodes 204 and 205 as illustrated in FIG. 3A. When a positive drive voltage is applied to the individual electrode 203, an electric field occurs from the individual electrode 203 toward the common electrodes 204 and 205 as illustrated in FIG. 4. The piezoelectric material is adapted to inflate in the electric field direction and to deflate in a direction orthogonal to the electric field upon the application of the electric field. Therefore, the piezoelectric material is provided so that the pressure chamber 302 is deflated by the electric field oriented in the direction from the individual electrode 203 toward the common electrodes 204 and 205.

When ink is discharged from the nozzle hole 102, the application of the drive voltage to the individual electrode 203 stops and thus the electric field of the piezoelectric material disappears. When the electric field of the piezoelectric material disappears, the piezoelectric effect is lost and the inflation of the piezoelectric material is eliminated, by which the pressure chamber 302 resumes the shape of the initial state. The ink held in the pressure chamber 302 has been discharged by the deflation of the pressure chamber 302, and therefore a space of the volume of the discharged ink is generated in the inside of the pressure chamber 302. This space is filled with the ink, which has been stored in the common liquid chamber 106, after passing through the throttle hole 105 of the rear throttle plate 104 and flowing into the pressure chamber 302 of the unit stack 103. The liquid level of the ink reaches the nozzle hole 102 of the orifice plate 101 due to a meniscus restoring force. When the liquid level of the ink reaches the nozzle hole 102, the ink refill of the pressure chamber 302 is completed.

As described hereinabove, ink is discharged to a recording medium by repeating the ink discharge caused by deflation of the pressure chamber 302 and the ink supply to the pressure chamber 302 from the common liquid chamber 106 to form characters and images based on the received recorded data onto the recording medium.

Method of Manufacturing Liquid Discharge Head

The following describes a method of manufacturing the liquid discharge head described hereinabove.

Manufacturing Unit Stack

As the piezoelectric material plate 201 made of piezoelectric material which constitutes the unit stack 103, a PZT (lead zirconium titanate) substrate of, for example, 57 mm×74 mm×about 0.24 mm is used. First, a rear surface alignment mark, which is made of a metal film, and the common electrode 205 are formed on the second surface of the piezoelectric material plate 201. The pattern of the common electrode 205 is formed in parallel to the longitudinal direction of the groove formed on the first surface. In order to apply voltage to all electrodes at the time of polarization treatment, all common electrodes 205 are connected at the end of the piezoelectric material plate 201.

The patterning of the rear surface alignment marks and the electrodes is implemented in a lift-off or etching method using photolithography of photoresist or a method of removing unnecessary parts by laser, cutting, milling, or the like. Since the piezoelectric material plate 201 has no unevenness on the substrate surface, a uniform resist film is able to be formed even by photoresist application with the usual spin coating. Subsequently, the resist patterning is performed by exposure and development and a metal film is vapor-deposited on the entire second surface of the piezoelectric material plate 201, by which a metal layer which is to be an electrode including the resist pattern, is formed on the piezoelectric material plate 201. Thereafter, the resist is removed and thereby a desired metal-film pattern is formed. In the portion where the common electrode 205 is formed, a Cr film of about 20 nm is formed as a foundation layer and further a Pd film of about 50 nm is formed and patterned. Further, Pb as a seed layer is plated with Ni of about 1000 nm and Ni on the surface is displaced by Au in displacement plating.

Thereafter, a surface alignment mark, which is used in alignment in grooving and stacking, is formed on the surface of the piezoelectric material plate 201 where grooves are formed. The surface alignment mark is formed of a metal film and the method of formation is the same as the method of forming the rear surface alignment mark.

After the formation of the surface alignment mark, the flat piezoelectric material plate 201 is grooved to form a plurality of grooves 202. The grooving is performed with the grooving positions determined using the surface alignment mark as a reference.

Subsequently, the individual electrodes 203 and the common electrodes 204 are formed on the inner peripheral surfaces of the plurality of grooves 202 formed in the piezoelectric material plate 201 by grooving. The patterning of the individual electrodes 203 is formed by a lift-off, laser, or polishing technique. In this specification, a patterning method of the individual electrodes 203 using the lift-off technique will be described.

First, in order to form the electrode separation region 206 in the bottom of the groove 202, a uniform resist film is formed by using spray coating, and then resist patterning is performed by exposure and development. Preferably the resist pattern width of the upper surface of the wall where the groove 202 is formed is smaller than the width of the upper surface of the wall so that the metal layer is formed over the entire area of the side wall surface of the groove in a later process. For example, the resist pattern width is set to 0.06 mm relative to the upper surface width of the wall of 0.12 mm.

Sputtering and vapor deposition are performed in order to form a metal layer which is to be an electrode including the resist pattern. Sputtering is superior in film formation properties on the side wall surface of the groove 202, and vapor deposition is superior in easiness of patterning by the lift-off technique. By removing the resist after the sputtering and the vapor deposition, a desired pattern of the metal film to be electrodes is formed on the surface of the piezoelectric material plate 201. On the electrode, a Cr film of about 20 nm is able to be formed as a foundation layer and an Au film of about. 1000 nm is able to be formed as an electrode layer. Alternatively, a Cr film of about 20 nm and a Pd film of about 50 nm are formed as a foundation layer and then patterned. Further, Pd as a seed layer is plated with Ni of about 1000 nm and Ni on the surface is displaced by Au in displacement plating.

Figure 2B:
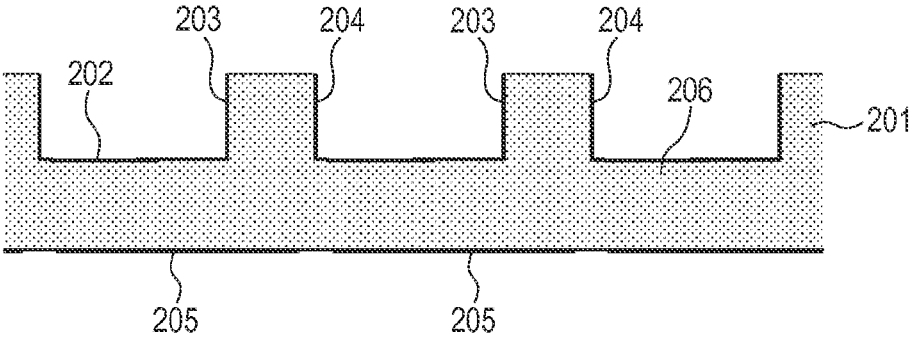
FIG. 2B is a front view of FIG. 2A.
Figure 2C:
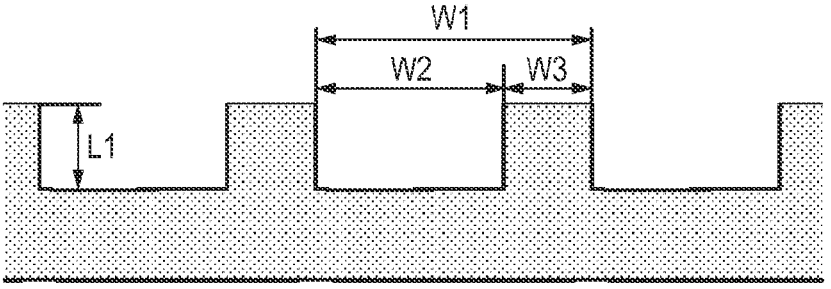
FIG. 2C is a diagram illustrating the dimensional relation of FIG. 2B.
Figure 2D:
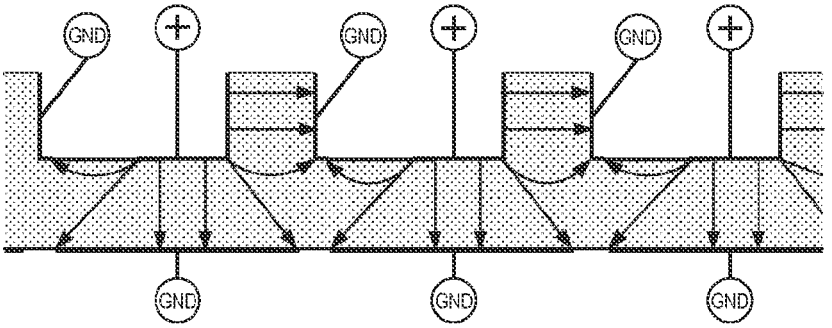
FIG. 2D is a diagram illustrating an electric field distribution in a state where a drive voltage is applied to electrodes.

Subsequently, a positive voltage is applied to the individual electrode 203 with the common electrodes 204 and 205 of the piezoelectric material plate 201 as the ground potential in order to perform polarization treatment, and thus an electric field occurs in a direction from the individual electrode 203 toward the common electrodes 204 and 205 as illustrated in FIG. 2B. As the conditions of the polarization treatment, a high electric field of 1 to 2 kV/mm is applied to the piezoelectric material for a given length of time in a state where the piezoelectric material plate 201 is heated at 100 to 150° C. The electrodes, however, are arranged at small intervals of 0.06 mm on the upper surface of the wall where the grooves 202 are formed, and therefore when the high electric field of 1 to 2 kV/mm is applied in air, it is likely that an atmospheric discharge or a creeping discharge occurs. Therefore, it is preferable to perform polarization treatment in oil or the like having high insulation properties such as silicone oil (breakdown voltage: 10 kV/mm or more). The silicone oil is removable after the polarization treatment by a hydrocarbon system solvent such as xylene, benzene, and toluene or a chlorinated hydrocarbon solvent such as methylene chloride, 1.1.1-trichloroethane, and chlorobenzene. After the polarization treatment, aging treatment is performed, if needed, to stabilize the piezoelectric properties. The aging treatment is to maintain the polarized piezoelectric material plate 201 at a high temperature for a given length of time (for example, to leave the piezoelectric material plate 201 in an environment at 100° C. for 10 hours). After the aging treatment, the piezoelectric material plate 201 constituting the bonding unit 301 is completed.

By pressing another substrate on which a thin and uniform adhesive layer is formed by spin coating, screen printing, or the like against the surface of the piezoelectric material plate 201 in order to bond the piezoelectric material plates 201, a thin and uniform adhesive layer is formed. To prevent the grooves 202 from being filled up with the adhesive, about 4 μm of thickness of the adhesive layer is appropriate on the surface of the piezoelectric material plate 201. After an adhesive of an epoxy system or the like is applied to the piezoelectric material plate 201, two piezoelectric material plates 201 are positioned facing each other so that the grooves 202 are accommodated in the bottoms of the grooves 202 on the other side and then pressure-bonded. At the bonding, alignment is performed using the rear surface alignment mark and the surface alignment mark or the like, which have been patterned at the formation of the grooves 202 or the electrodes, as marks. The thickness of the adhesive layer after the adhesion is preferably about 2 μm. Thus, the bonding unit 301 is formed.

In the bonding unit 301 which is formed by bonding the two piezoelectric material plates 201, the pressure chambers 302 and the first openings 303 are formed by the grooves 202 of the piezoelectric material plates 201. When a positive voltage is applied to the individual electrode 203 with the common electrodes 204 and 205 of the bonding unit 301 as the ground potential, an electric field occurs in a direction from the individual electrode 203 toward the common electrodes 204 and 205 in the piezoelectric material around the pressure chamber 302 as illustrated in FIG. 4.

Then, two or more bonding units 301 are stacked with the spacers 501 placed between the bonding units 301, by which the unit stack 103 is formed.

In this embodiment, 17 bonding units are stacked with the bonding units 301 shifted by L2 (=21.2 μm). Preferably each bonding unit 301 is bonded to each spacer 501 above and below the first openings 303 where there is no displacement in the piezoelectric material. With respect to the width W5 (=6.4 μm) of the first opening, however, the bonding units 301 are bonded to each other with the bonding units 301 shifted by L2 (=21.2 μm) and therefore the shift distance of the bonding unit 301 is long and there is no overlapped area between the upper and lower first openings 303. Therefore, as illustrated in FIG. 5, each spacer 501 is bonded between the bonding units 301 so as to cover the regions of the upper and lower first openings 303 and the region including a less-displaced portion in the piezoelectric material around the pressure chamber 302. In order to improve the mechanical strength of the unit stack 103, it is preferable to further bond a reinforced plate of piezoelectric material or ceramic having a thickness of 1 to 5 mm in the upper and lower portions of the stack of the bonding units 301.

The spacer 501 is bonded in a portion where the piezoelectric material is not or less displaced. Therefore, the material of the spacer 501 may be a metal such as stainless steel or nickel having a Young's modulus higher than the piezoelectric material. In order to, however, prevent interference to the displacement of the piezoelectric material and to prevent an occurrence of a crosstalk (machine vibration) by mutually transmitting the displacement of the periphery of each pressure chamber 302, it is preferable to use material having a Young's modulus lower than the piezoelectric material as the material of the spacer 501. Alternatively, a film-like laminated resist or a spin-coated resist is processed into a spacer shape by a photolithography technique and adhesive is applied onto the processed resist, and the finished piece may be used as the spacer 501.

Figure 8:
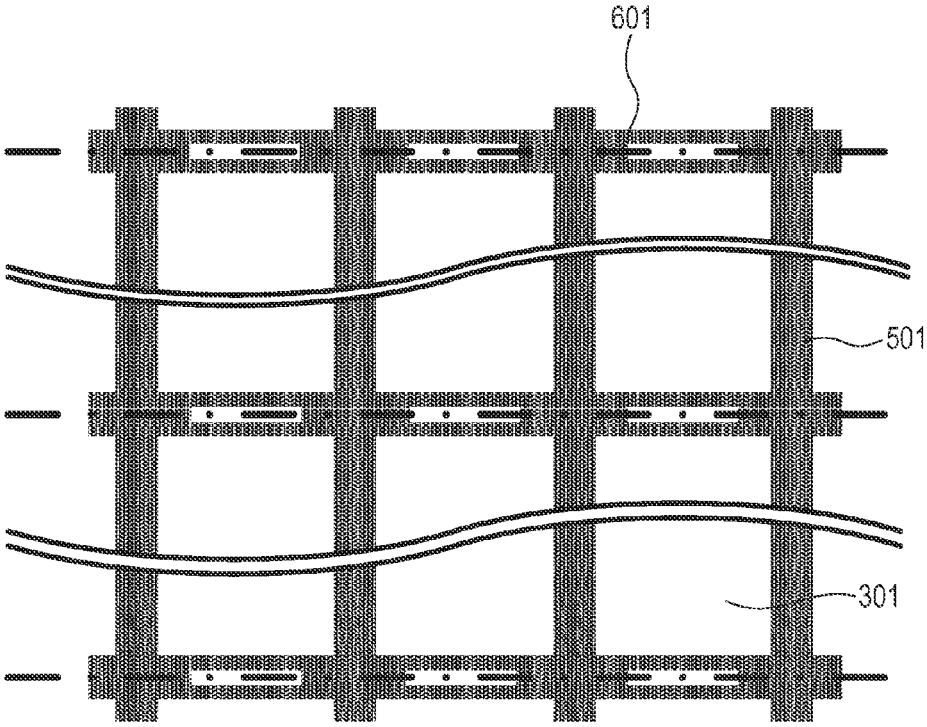
FIG. 8 is a top view illustrating the shape of a spacer located between stacked bonding units.

The displacement caused by the application of the drive voltage in the piezoelectric material around the pressure chamber 302 is as small as several tens nm and even 1 μm is enough for an interspace between the bonding units. Therefore, an adhesive layer used for the bonding is able to be used as the spacer 501. Accordingly, the adhesive is applied in a shape of the spacer 501 by screen printing or transfer to the bonded surface of the bonding unit 301 and then another bonding unit 301 is bonded to the surface of the adhesive, thereby enabling the formation of the spacer 501 and the bonding of the bonding units 301 at a time. As to the shape in which the adhesive is applied, as illustrated in FIG. 8, preferably the adhesive is applied in a grid pattern along the cutting plane indicated by an alternate long and short dash line which cuts the unit stack 103 in chips, including areas other than the portions where the spacers 501 are formed. The bonding of the bonding units 301 in this shape prevents the drug used in the resist development or polishing process from getting into the depth of the second openings 502. Even if conductive foreign substances enter the second opening 502, the inner peripheral surface of the second opening 502 is used as the common electrode 205 and thus serves as the ground potential, and therefore there is no problem.

In this embodiment, the common electrode 205 on the second surface of the piezoelectric material plate 201 is not formed in the area bonded with the spacer 501. This prevents the stack of the bonding units 301 from coming down because the common electrode 205 falls away from the piezoelectric material plate 201 when the spacer 501 is bonded onto the common electrode 205 due to weak bonding force between the common electrode 205 and the piezoelectric material plate 201. In the case of a strong bonding force between the common electrode 205 and the piezoelectric material plate 201, the bonding units 301 may be stacked after forming the common electrode 205 over the entire second surface of the piezoelectric material plate 201 and bonding the spacer 501 onto the common electrode 205. In this case, the patterning process of the common electrodes 205 is omitted.

Figure 9A:
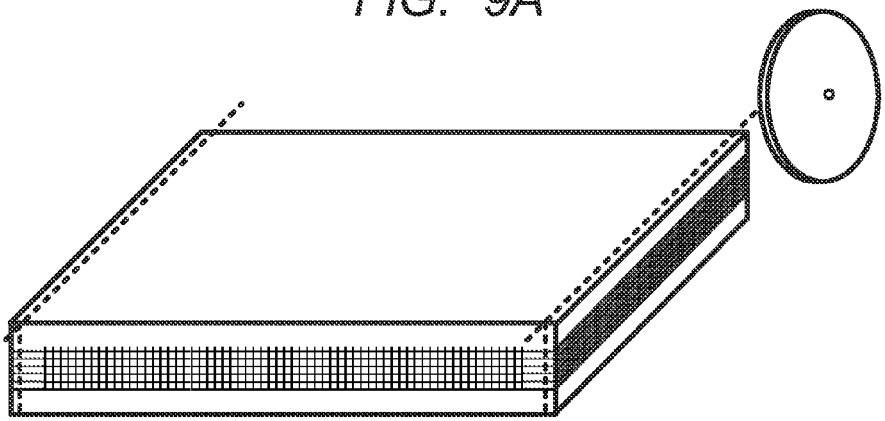
FIG. 9A is a perspective view illustrating a state where the unit stack illustrated in FIG. 5 is cut on the side surface.
Figure 9B:
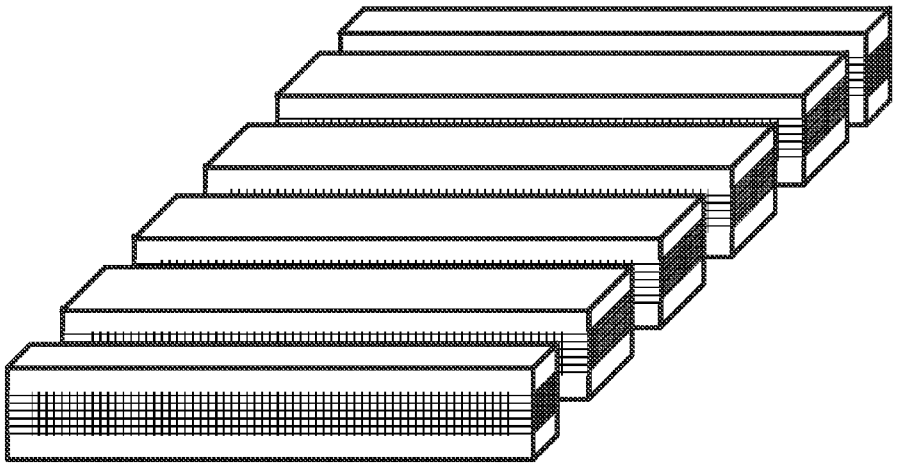
FIG. 9B is a perspective view illustrating a state where the unit stack in FIG. 9A is cut to length based on an intended use.

The bonding units 301 are stacked with each bonding unit 301 shifted in order to form the unit stack 103 and therefore the side surface of the unit stack 103 is stepped and not flat. Therefore, as illustrated in FIG. 9A, the unit stack 103 is cut on both side surfaces by a cutting process, by which the unit stack 103 is shaped in a cube. After the cutting on both side surfaces, as illustrated in FIG. 9B, the unit stack 103 is cut in chips by a cutting process so that each pressure chamber 302 has a desired length. The longer the pressure chamber 302 is, the larger the deflation volume of the pressure chamber 302 is when the drive voltage is applied and thus the greater the ink discharge force from the pressure chamber 302 is. If the pressure chamber 302 is too long, however, the amount of displaced piezoelectric material increases and therefore the response of the pressure chamber 302 to the waveform of the drive voltage is degraded. Therefore, it is preferable to set an optimal length of the pressure chamber 302 depending on the viscosity or the size of drop of discharged ink. In this embodiment, the unit stack 103 is cut with the length of the pressure chamber 302 set to 10 mm because greater importance is given to the discharge force. In the case where the viscosity of discharged ink is not so high and a small amount of ink is discharged, however, it is preferable to set the length of the pressure chamber 302 to 2 to 5 mm. Both end surfaces of the unit stack 103 cut in chips are polished by grindstone, where the pressure chambers 302 and the first openings 303 are exposed in the end surfaces. The end surfaces are polished so that the surface roughness of both end surfaces is Ra 0.4 μm, the flatness of the end surfaces is 10 μm or less since the orifice plate 101 and the rear throttle plate 104 are attached to the end surfaces, and the parallelism between the end surfaces is 30 μm or less.

Subsequently, an electrode for drawing out the wires from the common electrode 204, which is provided on the inner peripheral surface of the first opening 303, and from the common electrode 205, which is provided on the inner peripheral surface of the second opening 502, is formed on the front end surface 801 of the unit stack 103. The front end surface 801 has unevenness such as the pressure chambers 302, the first openings 303, the second openings 502, and the like and therefore film resist laminating or spray coating is used, instead of usual spray coating. It is difficult to uniformly expose the inside of the holes of the pressure chambers 302, the first openings 303, and the second openings 502. Therefore, preferably negative-type resist is used because it requires only exposure of the exterior of the holes. First, the front end surface 801 of the unit stack 103 is laminated with the film resist, and then the first openings 303, the second openings 502, and the periphery thereof are exposed by exposure and development. In this state, the pressure chamber 302 and the periphery thereof is covered with the resist. An electrode layer is formed in this state, by which the front-end electrode 802 is formed, and the common electrodes 204 and 205 on the inner peripheral surfaces of the first opening 303 and the second opening 502 are electrically connected to the front-end electrode 802. Furthermore, a mask is formed on the upper end surface 803 and on the lower end surface 804 of the unit stack 103, thereby forming the common electrode connection portions 805 and 806, which are the connection portions to the common electrode distribution cable 109. Thereafter, the resist is removed to perform lift-off, and thus electrodes are formed in a desired pattern. An interspace of 1 to 2 μm generated by adhesive layers is present between the piezoelectric material plates 201 of the bonding units 301 which form the unit stack 103. If, however, the foundation layer is formed and the plate processing is performed on the front end surface 801 so that the electrode is formed on the surface of the piezoelectric material plate 201, the front-end electrode 802 is electrically connected to the common electrodes 204 and 205 through the interspace generated by the adhesive between the piezoelectric material plates 201.

Subsequently, the electrode for drawing out the wire from the individual electrode 203, which is provided on the inner peripheral surface of the pressure chamber 302, is formed on the rear end surface 811 of the unit stack 103. Similarly to the front end surface 801, the rear end surface 811 has unevenness and therefore the electrode patterning on the rear end surface 811 is formed by a lift-off method using film resist laminating. The film resist is laminated on the rear end surface 811 of the unit stack 103 and the periphery of the pressure chamber 302 is exposed by exposure and development. The subsequent processing of the electrode forming method is the same as for the front-end electrode 802.

Rear Throttle Plate Bonding

Figure 6B:
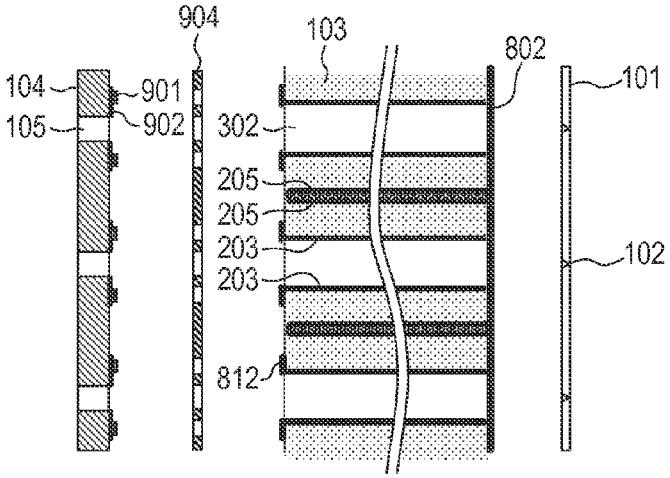
FIG. 6B is a sectional view illustrating a state before an orifice plate and the rear throttle plate are bonded to the unit stack.

In the rear throttle plate 104, the throttle holes 105 as through-holes are formed in the silicon substrate by etching or the like and thereafter the electrode 902 and the lead wire 903 are formed. Furthermore, an insulating film is formed on the surface of the rear throttle plate 104, excluding the portion where the bump 901 is formed on the rear throttle plate 104 and the portion connected to the individual electrode distribution cable 110, and the photosensitive adhesive film 904 is laminated on the portion to which the unit stack 103 is bonded. As illustrated in FIG. 6B, the photosensitive adhesive film 904 has holes formed by removing the portions overlapping the throttle holes 105 at bonding and the portions where the bumps 901 are formed by exposure and development. In FIG. 6B, the photosensitive adhesive film 904 is illustrated spaced apart from the rear throttle plate 104 in order to clarify the positions of the holes of the photosensitive adhesive film 904. Actually, however, the photosensitive adhesive film 904 is bonded to the rear throttle plate 104. After the bumps 901 are formed by bonding or the like in predetermined positions of the rear throttle plate 104, the rear end surface 811 of the unit stack 103 is brought into contact with the rear throttle plate 104 and then the rear end surface 811 and the rear throttle plate 104 are pressure-bonded under heat. In this bonding process, the bump 901 crushes and is electrically connected to the rear-end electrode 812 of the unit stack 103. Moreover, the bonded surface between the unit stack 103 and the rear throttle plate 104 is sealed with the photosensitive adhesive film 904, which thereby prevents liquid from leaking from the portions other than each communication portion between the pressure chamber 302 and the throttle hole 105.

Figure 6C:
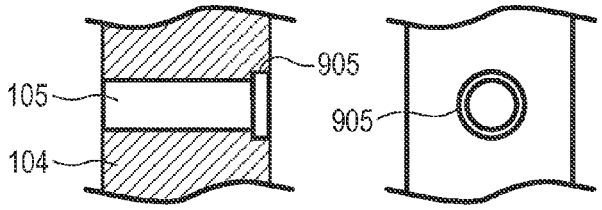
FIG. 6C is a diagram including a sectional view and a front view of a throttle hole.

In the method of bonding the unit stack 103 to the rear throttle plate 104, epoxy adhesive may be used for the bonding without using the photosensitive adhesive film 904. In the bonding method using the adhesive, first, a uniform adhesive layer is formed on another flat substrate by spin coating, screen printing, or the like and then the rear end surface 811, which is a bonded surface of the unit stack 103, is pressed against and separated from the adhesive layer, by which a uniform adhesive layer is formed on the rear end surface 811. To prevent the pressure chambers 302 of the unit stack 103 and the throttle holes 105 of the rear throttle plate 104 from being filled up with the adhesive, the quantity of the applied adhesive needs to be controlled appropriately. After the adhesive is applied to the unit stack 103, bonding alignment to the rear throttle plate 104 is performed and then the unit stack 103 is pressure-bonded to the rear throttle plate 104. In the bonding process, the bump 901 smashes into the adhesive layer of the rear end surface 811 and crushes so as to be electrically connected to the rear-end electrode 812. Moreover, the bonded surface between the unit stack 103 and the rear throttle plate 104 is sealed with the adhesive layer, which thereby prevents liquid from leaking from the portions other than each communication portion between the pressure chamber 302 and the throttle hole 105. Meanwhile, to prevent the adhesive from sticking out to the pressure chamber 302, the first opening 303, or the second opening 502 at the bonding, an adhesive escape groove 905 is formed on the bonded surface side of the throttle hole 105 of the rear throttle plate 104 as illustrated in FIG. 6C to reduce the amount of stickout of the adhesive.

Subsequently, an insulating film is formed on the surface of the individual electrode 203 provided on the inner peripheral surface of the pressure chamber 302, the surface of the common electrode 204 provided on the inner peripheral surface of the first opening 303, and the surface of the common electrode 205 provided on the inner peripheral surface of the second opening 502. An insulating film, however, is not formed on the common electrode connection portions 805 and 806 connected to the distribution cable such as an FPC and on the connection portions of the lead wires 903 exposed to the upper and lower ends of the rear throttle plate 104. Therefore, when the insulating film is formed, the common electrode connection portions 805 and 806 and the connection portions of the lead wires 903 exposed to the upper and lower ends of the rear throttle plate 104 are masked with a tape or the like.

For the insulating film, Parylene® (N) is used as an example, and the insulating film is formed by a chemical vapor deposition method. The thickness of the insulating film is appropriately about 5 μm. Parylene® is superior in throwing power and the insulating film is easily formed on the deep walls of the pressure chamber 302, the first opening 303, and the second opening 502. To improve the adhesion of Parylene®, preferably UV/ozone treatment is performed for about five minutes at ordinary temperatures before the insulating film formation. Application of a coupling agent after the UV/ozone treatment further improves the adhesion. Particularly, when Au is used for the front-end electrode 802 of the unit stack 103, surface finishing with a triazine thiol coupling agent is effective. Moreover, in the case where a silicon substrate is used for the rear throttle plate 104 and an oxide film is formed on the surface, a silan coupling agent is effective. The surface finishing with a coupling agent is carried out by applying a coupling agent diluted by IPA (isopropyl alcohol) in a thin layer to the surface and oven-drying the surface.

Orifice Plate Bonding

The orifice plate 101 is formed by a Ni electroforming process, and an ink-repellent treatment is performed on the rear surface opposite to the surface bonded to the front end surface 801 of the unit stack 103. As the material used for the ink-repellent treatment, silane- or fluorine-based material is selected, and the material is coated by vapor deposition or the like. While the orifice plate 101 and the unit stack 103 are bonded together with adhesive, an adhesive escape groove is formed on the bonded surface side of the nozzle hole 102 in order to prevent the adhesive from covering in the nozzle hole 102 of the orifice plate 101. The escape groove is preferably smaller than the cross section of the pressure chamber 302 in order to prevent the accumulation of bubbles in ink to be discharged. When the thickness of the orifice plate 101 is set to 80 μm, the escape groove has a diameter (ϕ) of 80 μm and a thickness of 60 μm. The method of bonding the orifice plate 101 to the unit stack 103 using the adhesive is the same as the method of bonding the unit stack 103 to the rear throttle plate 104.

FPC Bonding

In the FPC, the individual electrode 203 is drawn out from the upper and lower ends of the rear throttle plate 104 and crimped to the individual electrode distribution cable 110, and the common electrodes 204 and 205 are drawn out from the upper end surface 803 and the lower end surface 804 of the unit stack 103 and crimped to the common electrode distribution cable 109. For the crimping, an anisotropic conductive film (ACF) is used. Appropriately, crimping is performed for about 10 seconds under the temperature environment of 150° C. and the pressure environment of 3 MPa as crimping conditions. After the crimping, the area in the vicinity of the crimped portion is reinforced by an adhesive.

Bonding of Common Liquid Chamber

The common liquid chamber 106 is formed by machining a SUS substrate. The common liquid chamber 106 is bonded to the rear throttle plate 104 with an adhesive. The method of bonding the common liquid chamber 106 to the rear throttle plate 104 is the same as the method of bonding the unit stack 103 to the rear throttle plate 104.

The liquid discharge head is completed through the above processes.

The unit stack 103 of this embodiment is formed by stacking the piezoelectric material plates 201 and no continuous groove is formed around the pressure chamber 302. Therefore, the unit stack 103 has high stiffness and does not deteriorate in durability even if the length of the pressure chamber 302 is increased to discharge high-viscosity ink. Accordingly, even if the high-viscosity ink is discharged from the pressure chamber 302, the unit stack 103 is not damaged. Furthermore, since no groove is formed around the pressure chamber 302, the distance between pressure chambers 302 adjacent to each other is able to be reduced, which enables the pressure chambers 302 to be densely arranged in the unit stack 103. This enables high-resolution recording on a recording medium.

Second Embodiment

Even if the individual electrode 203 provided on the inner peripheral surface of the pressure chamber 302 and the common electrodes 204 and 205 provided on the inner peripheral surface of the first opening 303 and the inner peripheral surface of the second opening 502 in the first embodiment are replaced in position with each other, the same advantageous effects are achieved. While an insulating film such as Parylene® is formed on the surface of the individual electrode 203 on the inner peripheral surface of the pressure chamber 302, the discharged liquid is conductive and therefore, in the case of existence of a pinhole in the insulating film, the individual electrode 203 might be eroded. Accordingly, in order to prevent a problem even in the case of existence of a pinhole, there is provided a liquid discharge head where the electrode on the inner peripheral surface of the pressure chamber 302 is provided as a common electrode 911 and used at the ground potential.

The configuration of a unit stack 103 according to a second embodiment will be described with reference to FIGS. 10A to 10D. The liquid discharge head is adapted to implement 1200 dpi image resolution, in other words, 21.2 μm dot size.

Figure 10A:
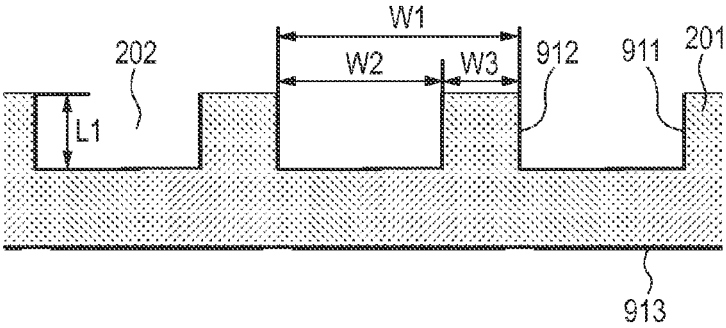
FIG. 10A is a front view of a piezoelectric material plate according to a second embodiment.

As illustrated in FIG. 10A, the piezoelectric material plate 201 in this embodiment has a groove 202 which forms a pressure chamber 302 and a first opening 303 on a first surface. The common electrode 911 is formed on one side wall surface of the groove 202 and on a part of the bottom continued therefrom. Moreover, an individual electrode 912 is formed on the other side wall surface of the groove 202. In addition, on a second surface which is a rear surface opposite to the first surface of the piezoelectric material plate 201, an individual electrode 913 is formed in a portion opposing to the portion where the common electrode 911 is disposed. The individual electrodes 912, each of which is composed of two electrodes and provided on the inner peripheral surface of the corresponding first opening 303, drive the different pressure chambers 302. Therefore, if the individual electrodes 912 come in contact with each other, a short circuit occurs. Accordingly, the width of the first opening 303 needs to be widely formed. With respect to the individual electrode 913 composed of two electrodes provided on the inner peripheral surface of the second opening 502, the same as for the first opening 303 applies.

Figure 10B:
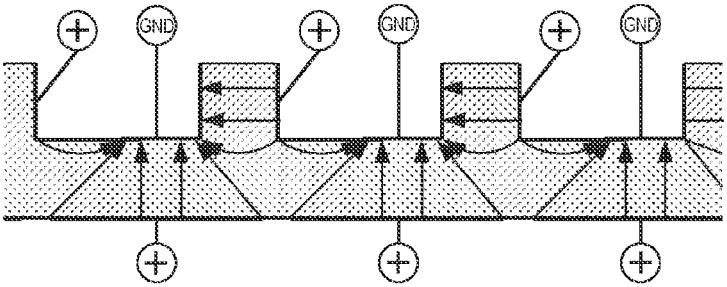
FIG. 10B is a diagram illustrating en electric field of a state where a drive voltage is applied to electrodes.
Figure 10C:
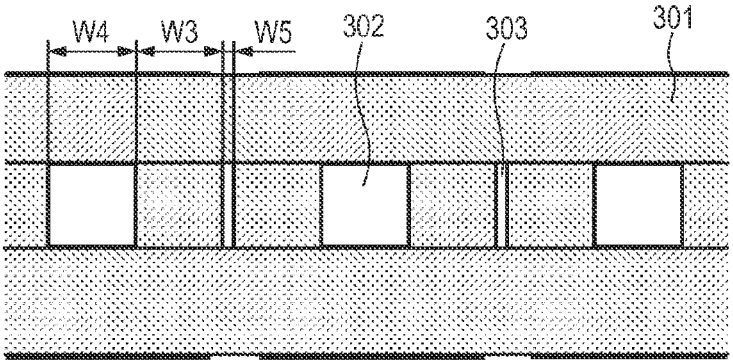
FIG. 10C is a front view illustrating a bonding unit in which piezoelectric material plates are bonded.
Figure 11:
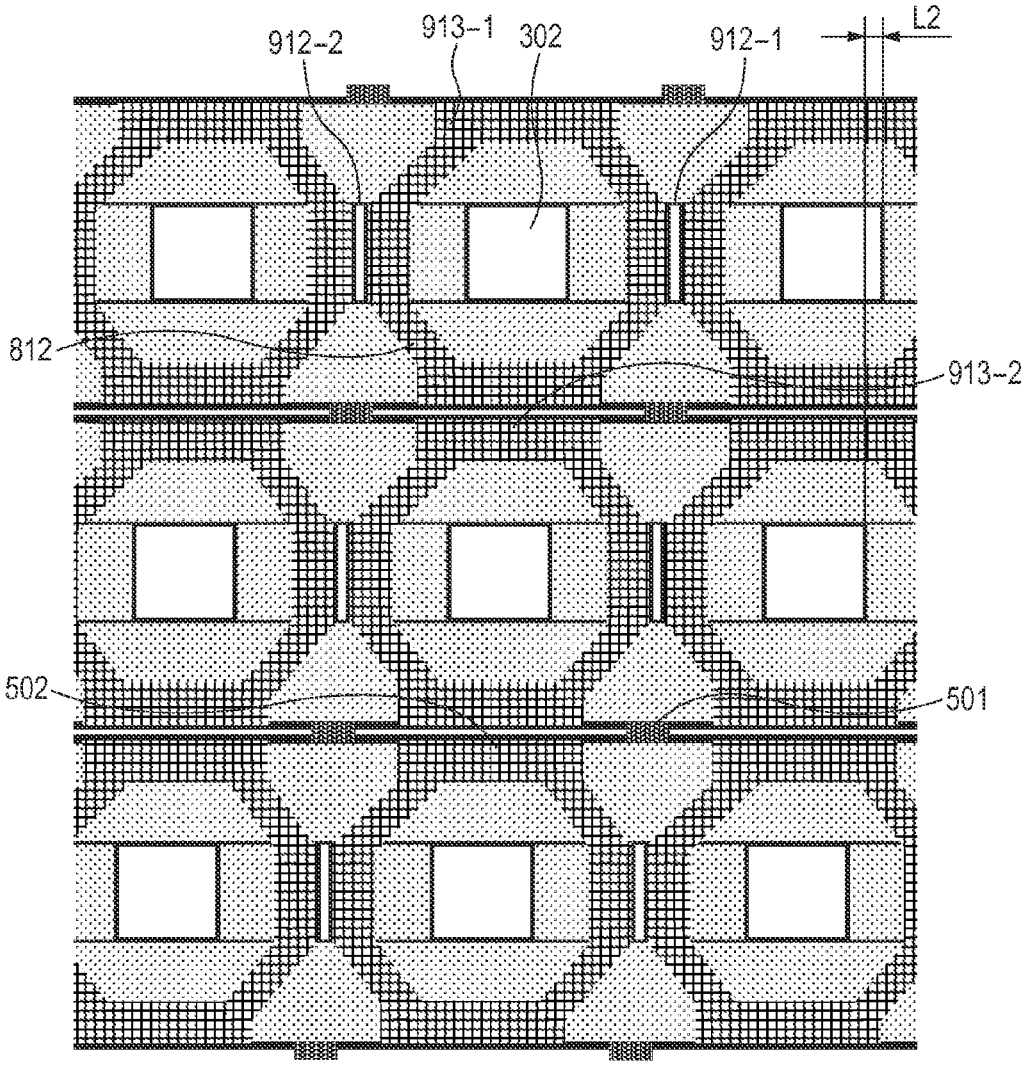
FIG. 11 is a front view of a unit stack in which the bonding units one of which is illustrated in FIG. 10C are stacked.

In this embodiment, the dot size is 21.2 μm and therefore the thickness of the piezoelectric material plate 201 is assumed to be 237 μm. As illustrated in FIG. 10A, the groove 202 has a pitch W1 of 381.6 μm, which is 18 times that of the dot size, a depth L1 of 118 μm, a width W2 of 263.6 μm, and a wall thickness W3 of 118 μm. Moreover, as illustrated in FIG. 10C, the pressure chamber 302 having the common electrode 911 on the inner peripheral surface has a width W4 of 118 μm, and the first opening 303 having the individual electrode 912 on the inner peripheral surface has a width W5 of 27.6 μm. As illustrated in FIG. 11, the bonding units 301 are stacked with the spacers 501 placed therebetween and with a shift of a pitch L2 (=21.2 μm) of the pressure chamber 302. The height of the spacer 501 is set to 23.2 μm including the adhesive layer in order to prevent a short circuit of the individual electrode 913 composed of two electrodes provided on the inner peripheral surface of the second opening 502.

The unit stack 103 is provided on the front end surface 801 of the unit stack 103 and has a front-end electrode 802 which is electrically connected to the common electrode 911 provided on the inner peripheral surface of the pressure chamber 302. The individual electrode 912 provided on the inner peripheral surface of the first opening 303 and the individual electrode 913 provided on the inner peripheral surface of the second opening 502 are not electrically connected to the front-end electrode 802. This front-end electrode 802 is extended from the front end surface 801 of the unit stack 103 to an upper end surface 803 and to a lower end surface 804 and then connected to the common electrode distribution cable 109 in common electrode connection portions 805 and 806. The front-end electrode 802 is formed on an end surface of the spacer 501 in the front end surface 801. As in this embodiment, however, if the spacer 501 is high, it is difficult to form an electrode on the end surface of the spacer 501 in some cases. In that case, bumps, electrodes, and wires may be formed, similarly to the rear throttle plate 104, on the orifice plate 101 bonded to the front end surface 801 and then the common electrode 911 may be drawn out, instead of the front-end electrode 802. Moreover, if the orifice plate 101 is conductive as in the case where the orifice plate 101 is formed by a Ni electroforming process, the orifice plate 101 itself may be used as a lead wire of the common electrode 911.

Figure 10D:
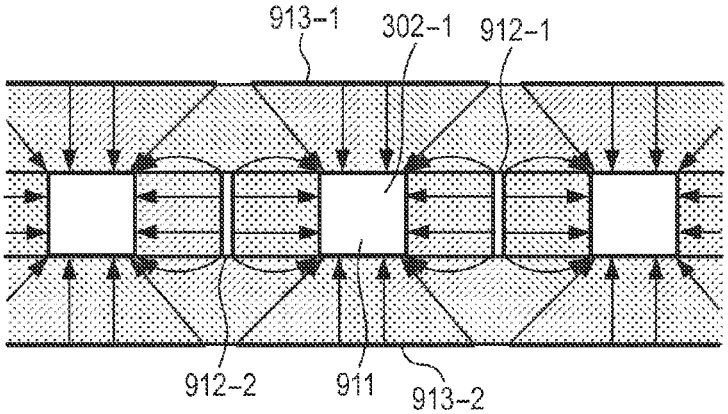
FIG. 10D is a diagram illustrating an electric field in a state where a drive voltage is applied to the electrodes.

Furthermore, the unit stack 103 has a rear-end electrode 812 which is provided on the rear end surface 811 of the unit stack 103 and electrically connected to the individual electrodes 912 and 913 provided on the inner peripheral surfaces of the first opening 303 and the second opening 502. Note that the common electrode 911 provided on the inner peripheral surface of the pressure chamber 302 is not electrically connected to the rear-end electrode 812. In order to displace the piezoelectric material around the pressure chamber 302 in this embodiment, as illustrated in FIG. 10D, one drive signal needs to be supplied to the four individual electrodes 912-1, 912-2, 913-1, and 913-2. Therefore, as illustrated in FIG. 11, the rear-end electrode 812 is formed so as to be connected to the four individual electrodes 912-1, 912-2, 913-1, and 913-2 and electrically connected to the bump 901 of the rear throttle plate 104. Alternatively, the rear-end electrode 812 is formed for each of the four individual electrodes 912-1, 912-2, 913-1, and 913-2 and the rear-end electrodes 812 may be connected through the bumps 901 of the rear throttle plate 104.

Other parts of the configuration are the same as those of the first embodiment.

The operation of discharging ink by the liquid discharge head which discharges ink having the configuration described hereinabove is the same as the operation of discharging ink of the first embodiment. The common electrode 911, however, is provided on the inner peripheral surface of the pressure chamber 302 and the individual electrodes 912 and 913 are provided on the inner peripheral surface of the first opening 303 and the inner peripheral surface of the second opening 502. Therefore, when a positive voltage is applied to the individual electrodes 912 and 913 with the common electrode 911 of the bonding unit 301 as the ground potential, an electric field occurs in a direction from the individual electrodes 912 and 913 toward the common electrode 911 in the piezoelectric material around the pressure chamber 302 as illustrated in FIG. 10D. This direction of the electric field is opposite to the direction of the electric field of the first embodiment. The difference in the direction of the electric field has no effect on the displacement of the piezoelectric material.

Method of Manufacturing Liquid Discharge Head

The following describes a method of manufacturing the liquid discharge head described hereinabove. Only parts different from the method of manufacturing the liquid discharge head in the first embodiment will be described.

A metal film is formed on the surface having the grooves 202 of the piezoelectric material plate 201. Regarding the metal film, however, on the side surface of the wall forming the groove 202, which corresponds to the individual electrode 912 and provided on the inner peripheral surface of the first opening 303, the metal film is formed on the surface so as not to be formed on the bottom of the groove 202. If the metal film is formed on the bottom of the groove 202, two individual electrodes 912 easily come in contact with each other on the inner peripheral surface of the first opening 303 when the piezoelectric material plates 201 are bonded together. The above way of forming the metal film is employed to prevent the contact between the individual electrodes 912. In addition, with respect to the individual electrode 913 formed on the second surface of the piezoelectric material plate 201, a drive voltage is applied to the adjacent pressure chambers 302 and therefore a metal film is not formed in the portion to which the spacer 501 is bonded without fail.

For polarization treatment, a positive voltage is applied to the individual electrodes 912 and 913 with the common electrode 911 of the piezoelectric material plate 201 as the ground potential. When the voltage is applied to the individual electrodes 912 and 913, an electric field occurs in the piezoelectric material of the piezoelectric material plate 201 in a direction from the individual electrodes 912 and 913 toward the common electrode 911 as illustrated in FIG. 10B and polarization is performed.

The spacer 501 for stacking the bonding units 301 has a height which is as high as 23.2 μm and therefore it is difficult to use an adhesive as the spacer. Therefore, the spacer 501 is formed by using a photosensitive adhesive film or a film resist.

For the rest, the same manufacturing method as for the first embodiment is used, by which the liquid discharge head is completed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-140842, filed Jun. 22, 2012, which is hereby incorporated by reference herein in its entirety.

What is claimed is:

1. A liquid discharge head comprising:

a surface plate having a plurality of discharge ports for discharging liquid; and a liquid discharge body having a discharge portion for supplying the liquid to the discharge ports, wherein the discharge portion and an opening are alternately arranged on the liquid discharge body and the liquid discharge body includes a bonding unit formed by combining two piezoelectric material plates, and each of the piezoelectric material plates is provided with a plurality of grooves on a first surface and has a first electrode on one side wall surface and the bottom of at least one of the grooves of the piezoelectric material plate, a second electrode on the other side wall surface of the at least one of the grooves of the piezoelectric material plate, and a third electrode on a second surface which is a rear surface opposite to the first surface of the piezoelectric material plate, each of the piezoelectric material plates is polarized in a direction connecting the first electrode and the second electrode and also in a direction connecting the first electrode and the third electrode, and the two piezoelectric material plates are bonded so that the first surfaces face each other to form the bonding unit.

2. The liquid discharge head according to claim 1, wherein one side wall surface of one of the grooves of one of the piezoelectric material plates and one side wall surface of one of the grooves of the other of the piezoelectric material plates face each other, spaced apart from each other, by which the discharge portion with the first electrode formed on the inner peripheral surface is formed; and the other side wall surface of one of the grooves of one piezoelectric material plate and the other side wall surface of the one of the grooves of the other piezoelectric material plate face each other, spaced apart from each other, by which the opening with the second electrode formed on the inner peripheral surface is formed.

3. The liquid discharge head according to claim 1, wherein the width of the discharge portion is wider than the width of the opening.

4. The liquid discharge head according to claim 1, wherein a plurality of the bonding units is stacked via a spacer, by which another opening with the third electrode formed on the inner peripheral surface is formed between the bonding units.

5. The liquid discharge head according to claim 1, wherein the first electrode is an individual electrode and the second electrode and the third electrode are common electrodes.

6. The liquid discharge head according to claim 1, wherein the first electrode is a common electrode and the second electrode and the third electrode are individual electrodes.

7. A liquid discharge head comprising:

a surface plate having a plurality of discharge ports for discharging liquid; and a liquid discharge body having a discharge portion for supplying the liquid to the discharge ports, wherein the liquid discharge body has an opening arranged alternately with the discharge portion, a first electrode is provided on an inner peripheral surface of the discharge portion, a second electrode is provided on an inner peripheral surface of the opening, a third electrode is provided on an outer surface of the liquid discharge head, and the liquid discharge body is polarized in a direction connecting the first electrode and the second electrode and also in a direction connecting the first electrode and the third electrode.

8. The liquid discharge head according to claim 7, wherein the first electrode is an individual electrode and the second electrode is a common electrode.

9. The liquid discharge head according to claim 7, wherein the first electrode is a common electrode and the second electrode is an individual electrode.

* * * * *